US006606796B2

(12) United States Patent
Stoneberg

(10) Patent No.: US 6,606,796 B2
(45) Date of Patent: Aug. 19, 2003

(54) DRAWING TOOL

(75) Inventor: J. Bruce Stoneberg, Oak Brook, IL (US)

(73) Assignee: Safe-T Products, Inc., Lombard, IL (US)

( * ) Notice: Subject to any disclaimer, the term of this patent is extended or adjusted under 35 U.S.C. 154(b) by 0 days.

(21) Appl. No.: 09/776,553

(22) Filed: Feb. 2, 2001

(65) Prior Publication Data

US 2002/0104225 A1 Aug. 8, 2002

(51) Int. Cl.[7] ..... B43L 9/04; B43L 7/08

(52) U.S. Cl. ..... 33/27.03; 33/484

(58) Field of Search ..... 33/27.02, 27.03, 33/27.031, 27.032, 27.033, 472, 484, 485, 492, 493, 486, 489, 490, 495, 487, 488, 491, 494

(56) References Cited

U.S. PATENT DOCUMENTS

| | | | | | |
|---|---|---|---|---|---|
| 2,561 | A | | 4/1842 | Card | |
| 165,519 | A | | 7/1875 | Swasey | |
| 392,143 | A | * | 10/1888 | Wright | 33/27.03 |
| 563,510 | A | * | 7/1896 | Savidge | 33/492 |
| 570,977 | A | | 11/1896 | Belcher | |
| 774,365 | A | | 11/1904 | Phenix | |
| 824,299 | A | * | 6/1906 | Huey | 33/27.03 |
| 1,001,229 | A | | 8/1911 | Stuart | |
| 1,327,154 | A | | 1/1920 | Golden | |
| 1,447,207 | A | * | 3/1923 | Golden | 33/27.03 |
| 1,498,485 | A | * | 6/1924 | Schmidtke | 33/484 |
| 1,576,800 | A | | 3/1926 | Tibony | |
| 1,825,266 | A | | 9/1931 | Fischer | |
| 1,877,341 | A | * | 9/1932 | Kurtz, Jr. | 33/492 |
| 2,054,420 | A | | 9/1936 | Hochman | |
| D135,282 | S | | 3/1943 | Green | |
| D142,051 | S | | 8/1945 | White | |
| 2,507,073 | A | | 5/1950 | White | |
| 2,537,473 | A | | 1/1951 | McCusker | |
| 2,554,099 | A | | 5/1951 | Ermold | |
| 2,612,690 | A | | 10/1952 | Cotton | |
| 2,614,329 | A | * | 10/1952 | Almorth | 33/484 |
| 2,722,055 | A | * | 11/1955 | Rader | 33/489 |
| 3,015,889 | A | | 1/1962 | Godman | |
| 3,263,334 | A | | 8/1966 | Mutter | |
| 3,474,538 | A | | 10/1969 | Kirkegaard | |
| 3,791,036 | A | | 2/1974 | Stober | |
| 4,267,638 | A | | 5/1981 | Heinz | |
| 4,353,166 | A | | 10/1982 | Kettlestrings | |
| 4,821,424 | A | * | 4/1989 | Loggins | 33/484 |
| 5,090,127 | A | | 2/1992 | Shapiro | |
| 5,193,284 | A | * | 3/1993 | Lin | 33/27.03 |
| 5,240,338 | A | | 8/1993 | Jye | |
| 5,426,859 | A | | 6/1995 | Concari | |
| 5,615,485 | A | * | 4/1997 | Stoneberg | 33/27.03 |
| D411,959 | S | | 7/1999 | Chan | |
| D412,717 | S | | 8/1999 | Urness | |
| 5,987,760 | A | * | 11/1999 | Hsu | 33/27.03 |
| D418,868 | S | | 1/2000 | Urness | |
| 6,286,216 | B1 | * | 9/2001 | Braun | 33/27.031 |
| 6,427,344 | B1 | * | 8/2002 | Smith et al. | 33/489 |

FOREIGN PATENT DOCUMENTS

| | | | | |
|---|---|---|---|---|
| DE | 4244533 A1 | * | 5/1993 | 33/27.02 |

* cited by examiner

*Primary Examiner*—G. Bradley Bennett
(74) *Attorney, Agent, or Firm*—Michael Best & Friedrich LLC

(57) ABSTRACT

A drawing tool comprising a protractor portion at one end and an elongated radius arm portion extending therefrom, with a pivot disc rotatably mounted in the tool, and an adjustable radius indicator slideably mounted in the radius arm portion, the pivot disc having an open circular pivot point and the adjustable radius indicator having means for automatically resisting unintended indicator movement.

20 Claims, 6 Drawing Sheets

DRAWING TOOL

FIELD OF THE INVENTION

This invention relates to drawing tools and, more particularly, to multipurpose drawing tools enabling the user to draw circles, to draw and measure lines, to construct and measure angles, and to produce geometric constructions and patterns.

BACKGROUND OF THE INVENTION

There are numerous drawing tools available in the prior art for drawing circles, drawing and measuring lines, constructing and measuring angles, and producing geometric constructions and patterns. Generally, these devices do not provide clearly visible, direct views of vertex points through an open pivot point for drawing circles, constructing and measuring angles, and producing geometric constructions and patterns. Rather, the user must approximate the positioning of the device over the vertex point, impairing the accuracy of the positioning of circles drawn with the device, or the accuracy of the construction and measurement of angles.

Additionally, even where devices are provided which can be used in performing all of the above functions, the devices require numerous parts, which make them expensive to construct and easy to damage. Where the devices are provided with adjustable radius indicators, i.e., movable parts which must stay put once positioned, the prior art devices are slow and cumbersome to use, and can be inaccurate.

Accordingly, an object of the present invention is to provide a drawing tool which provides an open pivot point providing a direct view of vertex points on drawing surfaces positioned under the tool;

It is another object of the present invention to provide a simple, inexpensive and easy-to-assemble drawing device for drawing circles, drawing and measuring lines, constructing and measuring angles, and producing geometric constructions and patterns;

Yet another object of the present invention is to provide a drawing tool with a movable radius indicator which is accurate and will stay put once positioned without a separate locking mechanism which must be manipulated once the indicator is in the desired location; and A still further object of the present invention is to provide a drawing tool having an elongated position for measuring and drawing lines and a protractor portion for measuring angles.

SUMMARY OF THE INVENTION

The present invention comprises a multi-purpose drawing tool including a protractor portion at one end and an elongated radius arm portion at the other end. An adjustable radius indicator, which is mounted in an elongated cavity for movement along the elongated radius arm portion, includes spring portions biased against the sides of the elongated cavity and pressure dimples riding in and engaging slots running alongside the elongated cavity to resist unintended indicator movement. The indicator rides in elongated slots in the bottom of the first member and along upstanding elongated ridges in the top of the first member. The drawing tool also includes dimples in its underside to prevent smudging of markings already on a drawing surface positioned below the tool.

BRIEF DESCRIPTION OF THE DRAWINGS

The objects, aspects and advantages of the invention will be better understood from the following detailed description of a preferred embodiment of the invention with reference to the drawings in which.

DETAILED DESCRIPTION OF THE INVENTION

Figure 1:
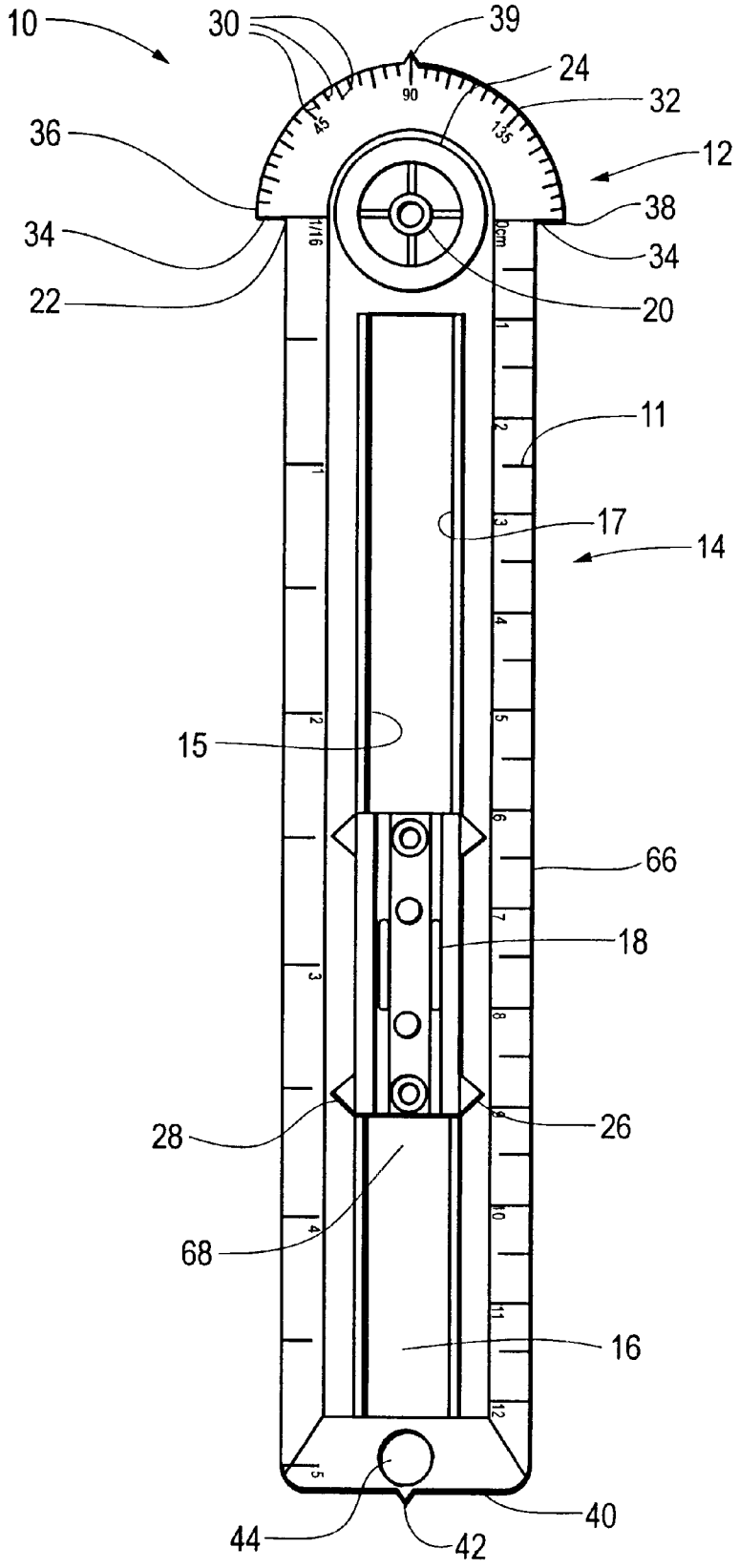
FIG. 1 is a top plan view of a multi-purpose drawing tool, including an adjustable radius indicator and a pivot disc, in accordance with the invention.

A multi-purpose drawing tool in accordance with the present invention 10 is generally illustrated in FIG. 1. Preferably, the body of the tool is made from a clear or opaque plastic. It is also preferable that the plastic be shatter-resistant, for durability and safety reasons.

The drawing tool has a body 11 including a protractor portion 12 at its proximal end, and an elongated radius arm portion 14 at its distal end. An elongated rectangular cavity 16 having opposite edges 15 and 17 is centered on the longitudinal axis of the radius arm portion. An adjustable radius indicator 18 which, as explained in more detail below, is designed to take advantage of the cross-sectional shape of radius arm portion 14, is mounted for sliding motion in cavity 16. Finally, a pivot disc 20 is rotatably mounted adjacent the proximal end of the tool, bridging the intersection 22 of the protractor portion and the radius arm portion of the device. Most notably, pivot disc 20 includes a open circular pivot point or hole 24. As shown in this figure, a bore 44 is formed adjacent the proximal end of the tool at the center of the circle defined by the half-moon protractor portion, for receiving pivot disc 20.

Protractor portion 12 is half-moon in shape, and projects beyond the lateral edges 26 and 28 of the radius arm portion. As shown, the protractor portion is marked off in 5° increments by a series of lines 30 printed along the outer edge 32 of the protractor portion. Every 15° is numbered just below these lines, so that the protractor bears degree markings from 15° to 165°, with the unmarked 0° and 180° positions at the bottom edge 34 of the protractor portion. A protruding pointer or spur 39 is provided along the outer edge 32 of the protractor portion opposite the 90° marking. Two complementary series of degree markings are provided, so that the user can measure angles beginning at 0° or at 180° from either one of the corners 36 and 38 of the protractor portion.

An integral radius arm portion 14 distally from the bottom edge 34 of the protractor portion. In the embodiment shown, the radius arm portion is approximately 5 inches in length, although it may be of any desired length. A series of metric system markings appears along edge 26 of the radius arm portion, while a series of English system markings appears along the edge 28 of the radius arm portion. Additionally, on the distal edge 40 of the radius arm portion, at its center, a protruding pointer or spur 42 (directly opposite spur 39 of the protractor portion) is provided to assist the user in aligning the tool with any straight line on a surface below the tool by positioning the tips of both spurs 39 and 42 on the line. Additionally, a hole 45 is provided just above spur 42. This hole can be used to store the tool on a ring in a notebook ring binder.

Figure 2:
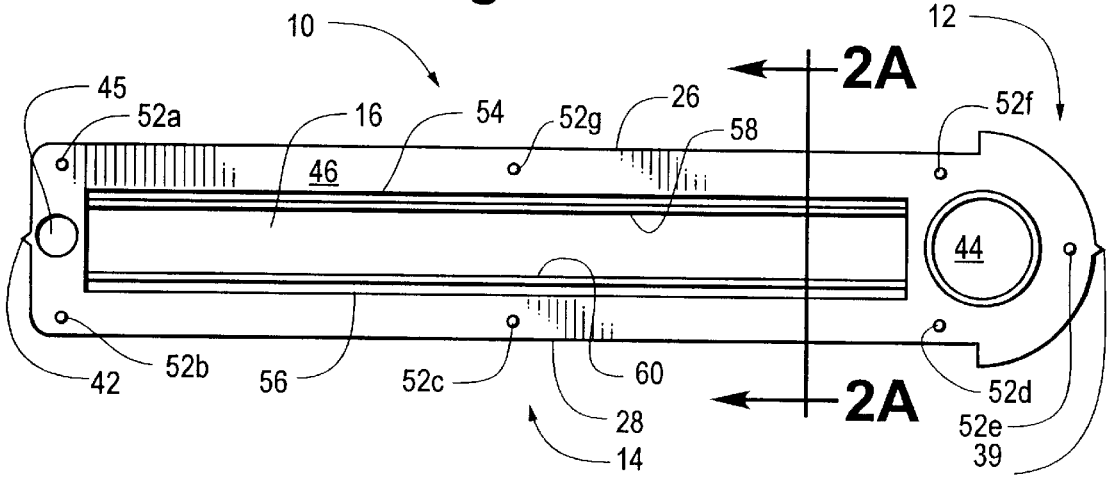
FIG. 2 is a bottom plan view of the tool of FIG. 1, with the adjustable radius indicator and pivot disc removed.
Figure 4A:
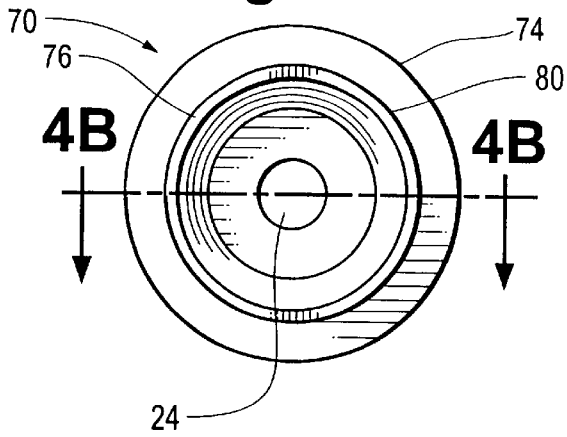
FIG. 4A is a top plan view of the bottom part of the pivot disc referred to above.
Figure 4B:
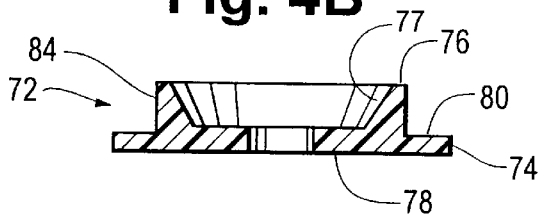
FIG. 4B is a cross-sectional view of the pivot disc taken along lines 4B—4B of FIG. 4A.
Figure 4C:
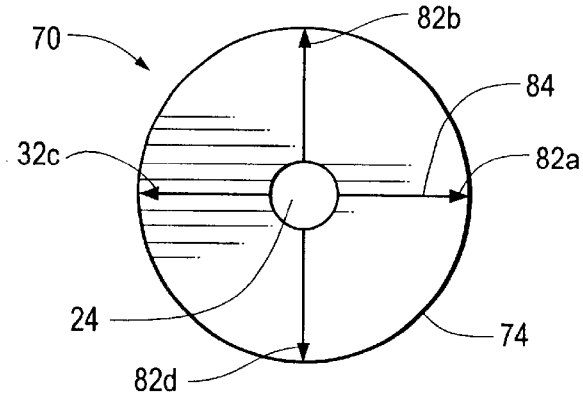
FIG. 4C is a bottom plan view of the pivot disc referred to above.

The underside 46 of the drawing tool of FIG. 1, with the adjustable radius indicator 18 and the pivot disc 20 removed, is illustrated in FIG. 2. Six dimples 52*a*–52*f* are spaced along either side of the underside of the drawing tool to maintain the underside of the drawing tool even with the underside of the pivot disc 20 which also includes dimples on its underside (82*a*–82*d*), as discussed below in connection with FIG. 4C. These dimples also minimize smudging of markings on the surface below the tool.

Figure 2A:
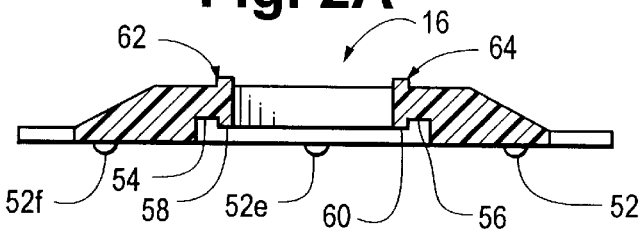
FIG. 2A is a cross-sectional view of a portion of the tool illustrated FIG. 2, taken along lines 2A—2A of FIG. 2.

FIG. 2A, which is an enlarged cross-sectional view taken along line 2A—2A in FIG. 2, shows a pair of elongated slots 54 and 56 formed in the bottom surface 46 of the radius arm portion of the tool, spaced from and along the opposite elongated edges of the cavity. These slots establish a pair of elongated upstanding ridges 58 and 60 immediately adjacent elongated rectangular cavity 16.

Figure 2B:
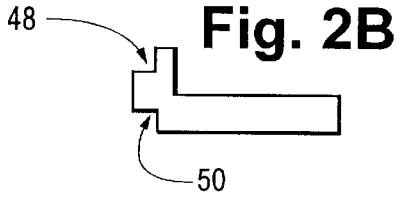
FIG. 2B is an enlarged cross-sectional view of a portion of the drawing tool along the inner edge of the bore receiving the pivot disc of the tool.

FIG. 2B, which is an enlarged cross-sectional view of a portion of the drawing tool along the inner edge of bore 44, shows integral annular shoulders 48 and 50 that encircle bore 44, at the top and the bottom of the tool.

Figure 3:
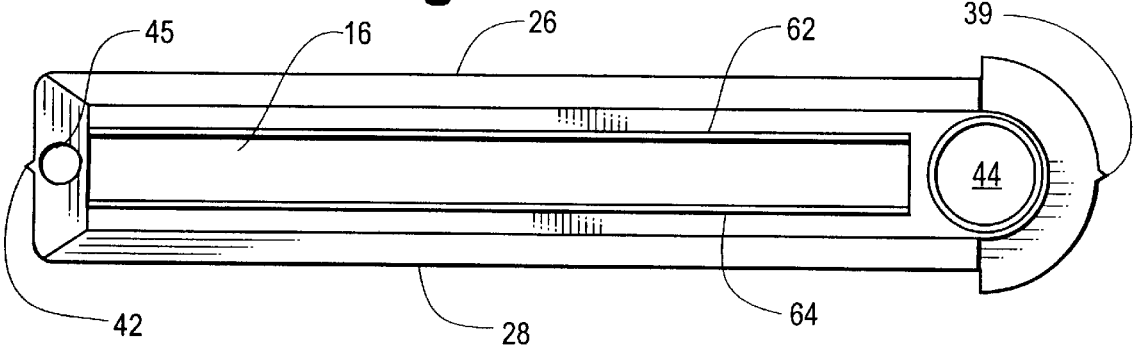
FIG. 3 is a top plan view of the tool of FIG. 1, with the adjustable radius indicator and pivot disc, as well as the linear and angular measurement markings removed.

The top surface of the tool, again with the adjustable radius indicator 18 and the pivot disc 20 removed, is illustrated in FIG. 3, sans linear and angular measurement markings. This figure shows generally parallel upstanding elongated ridges 62 and 64 running along the edge of elongated cavity 16, adjacent its opposite elongated edges. Ridges 62 and 64 and slots 54 and 56 cooperate with the radius indicator, as will be explained below.

Pivot disc 20 includes two interconnecting parts, a bottom part 70 and a top ring part 72, as illustrated respectively in FIGS. 4A–4C and 5A–5C. The bottom part and the top ring part are shaped and dimensioned to be press-fit and glued together.

Bottom part 70, which is preferably made of the same plastic as the body of the tool, includes an outer circumference 74 that is at least slightly larger than the circumference of bore 44 and a central bore or open circular pivot point 24, as referenced earlier. It also includes an inner annular lip 76, with a ramped inner surface 77, and a generally vertical annular surface 84 offset from the outer edge to define a flat annular band 80. The bottom surface 78 of part 70, illustrated in FIG. 4C, includes a series of four dimples 82*a*, 82*b*, 82*c* and 82*d* adjacent the outer edge of the part, spaced 90° from each other. In practice three or more such dimples may be used. Additionally, raised lines 84 are provided, extending from the outer circumference circular pivot point 24 to dimples 82*a*–82*d*. These lines are visible from the top of the tool as user looks down through the pivot disc, thereby enabling the user to both visualize the absolute center of the pivot point opening at the intersection of the lines, and to line up the center of the pivot point opening with the vertex of perpendicular intersecting lines on a sheet of paper positioned below the tool (not shown). The dimples on the underside of the pivot disc help maintain the disc in place as it is pressed down upon the underlying surface by the user and, by minimizing points of contact to the underlying surface, the dimples also minimize smudging.

Figure 5A:
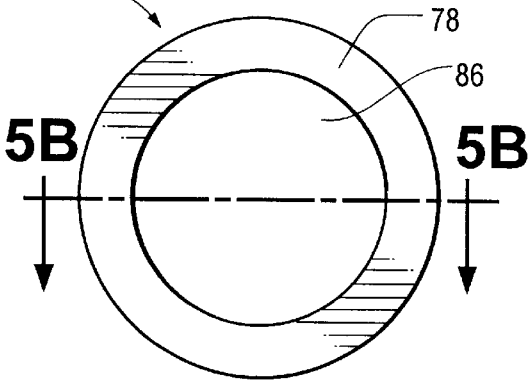
FIG. 5A is a top plan view of the top part of the pivot disc referred to above.
Figure 5B:
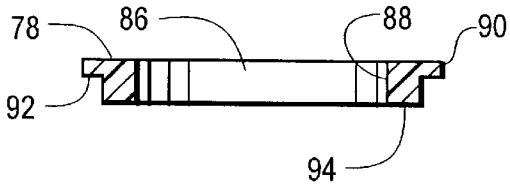
FIG. 5B is a cross-sectional view of the top part of the pivot disc, taken along lines 5B—5B of FIG. 5A.
Figure 5C:
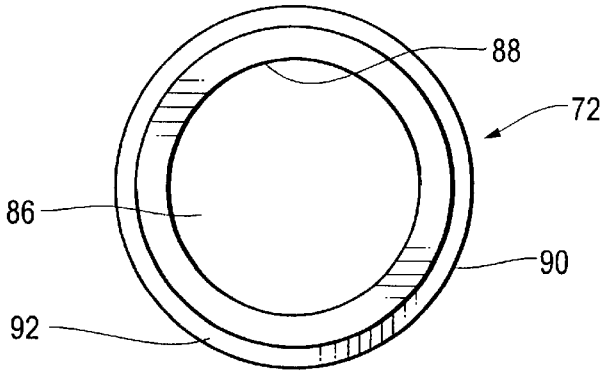
FIG. 5C is a bottom plan view of the pivot disc referred to above.

Top ring 72 is shown in FIGS. 5A–5C. The ring includes a central bore 86 with an inner annular surface 88 and an outwardly extending annular lip 90 along its circumference establishing an annular shoulder 92 (FIG. 5B). Ring 72 is dimensioned so that its inner annular surface 88 will fit snugly around the outer annular surface 84 of bottom part 70 when the two parts are press fit together. It is preferred that the annular ring be made of the same shatter-resistant plastic as the rest of the tool, but that a coloring agent be added to make the ring translucent or opaque.

Pivot disc 20 is assembled to the tool by placing part 70 in bore 44 so that annular lip 76 projects upwardly resting on shoulder 50 in the underside of the tool (FIG. 2B), and annular band 80 rides shoulder 48. Once part 70 is in this position, ring 72 is positioned above the top surface of the tool, and pressed home onto part 70 so that the two parts are locked in a pressed fit and glued relationship with annular surface 94 of the ring abutting the inner portion of band 80 of the bottom part and lip 90 riding on annular ring 48 of the top of the tool (FIG. 2A), leaving disc 20 free to rotate within bore 44. Additionally, translucent or opaque ring 70 directs the user's eye to the disc, to facilitate its use.

Figure 6:
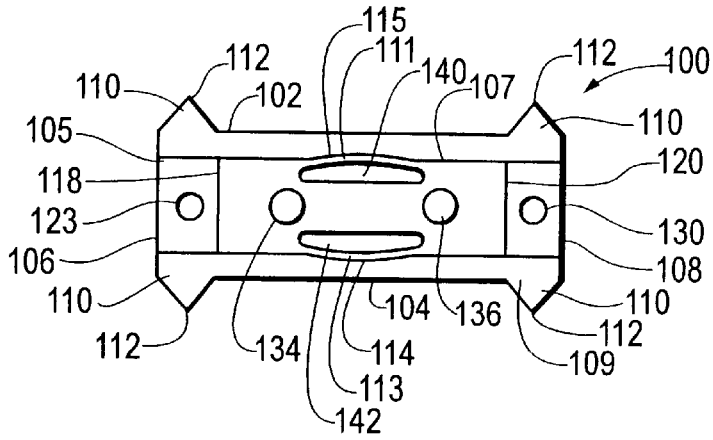
FIG. 6 is a bottom plan view of the top part of the adjustable radius indicator referred to above.
Figure 6A:
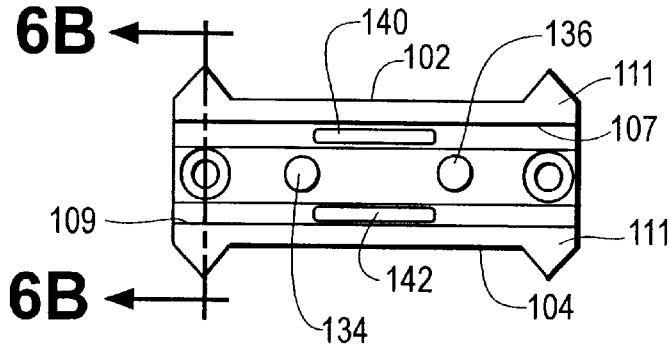
FIG. 6A is a top plan view of the adjustable radius indicator referred to above.

Adjustable radius indicator 18 is made of two parts, an upper part 100 and a lower part 150. Upper part 100 is illustrated in FIGS. 6–6C. Upper part 100 is generally rectangular in shape, with a top surface 101, a bottom surface 103, two generally parallel elongated outer edges 102 and 104, and two generally shorter edges 106 and 108 perpendicular to edges 102 and 104. The upper part also includes bores 66 and 68 at either end (FIG. 1) for receiving a marking instrument and drawing a circular line about pivot disc 20 or a straight line along cavity 16. The upper part also includes elongated shoulders 111 with four pointer portions 110 at opposite ends of elongated edges 102 and 104, so that they point outwardly from those lateral edges. Each pointer portion ends in a sharp tip 112.

Figure 6B:
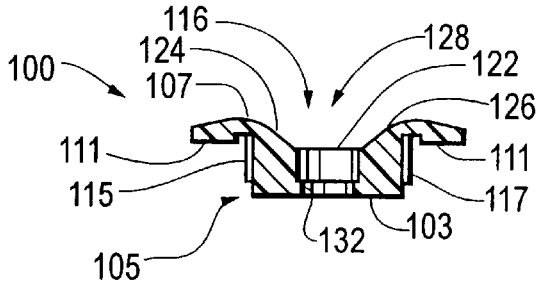
FIG. 6B is a cross-sectional view of the top part of the adjustable radius indicator taken along lines 6B—6B in FIG. 6.
Figure 6C:
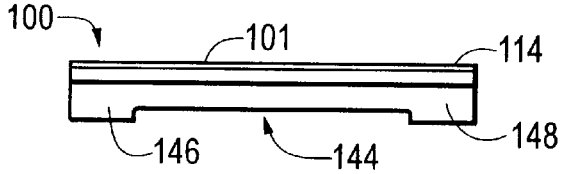
FIG. 6C is a side elevation view of the top part of the adjustable radius indicator referred to above.

An elongated trough 116 is formed in the top surface 114 of upper part 100 and extends from end 118 to end 120, as illustrated in FIG. 6B. Thus trough has a generally flat bottom surface 122 and angled outer walls 124 and 126. Bores 128 and 130 are provided along the central axis of the top part, adjacent ends 106 and 108. These bores, which are intended to receive a pencil point that extends through to a drawing surface below the tool (not shown), are conically shaped at their bottom, as defined by the annular angled wall 132.

Additionally, bores 134 and 136 are located along the central longitudinal axis of the adjustable radius indicator, spaced from edges 106 and 108. Bores 134 and 136 are intended to receive upstanding pins 172 and 174 (discussed below in connection with lower part 150) which project upwardly from the generally flat surface 122 of trough 116. These pins help align and attach the the two parts of the adjustable radius indicator and, most importantly, act as handles to enable the user to move the indicator of the fully assembled tool.

As shown in FIGS. 6A and 6B, the base 105 of the top part has elongated outer edges 107 and 109 inwardly offset from elongated edges 102 and 104. Generally oval relief slots 140 and 142 are provided in angled outer walls 124 and 126 intermediate ends 106 and 108 of the top part. The relief slots are positioned near edges 107 and 109 to define spring portions 111 and 113 along these edges. The relief slots and corresponding spring portions are biased outwardly to present engagement surfaces 115 and 117. This arrangement permits the spring portions to flex inwardly as the adjustable radius indicator is positioned in elongated cavity 16 and then to present an outwardly directed spring bias against the inner edges 15 and 17 of the elongated slot to produce friction between the engagement surfaces and the inner edges of the elongated cavity as the indicator is moved within the cavity, automatically resisting unintended or inadvertent indicator movement. This design eliminates any need for a separate locking mechanism which would have to be manipulated once the indicator is in the desired location.

As shown in FIG. 6C, the bottom of upper part 100 includes an elongated transverse slot 144 extending across base 105 of the top part, leaving rectangular protruding portions 146 and 148 extending across the base at either end of the part. As explained below, these protruding portions cooperate with the lower part of the radius indicator to lock the indicator to the tool.

Figure 7:
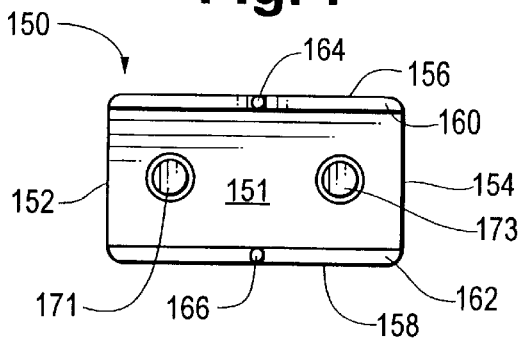
FIG. 7 is a top plan view of the lower part of the adjustable radius indicator referred to above.
Figure 7A:
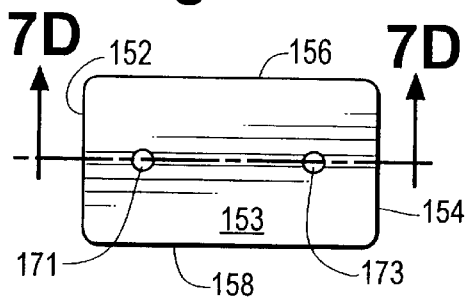
FIG. 7A is a bottom plan view of the lower part of the adjustable radius indicator referred to above.
Figure 7B:
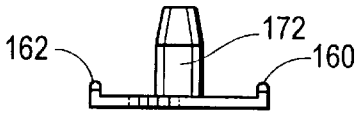
FIG. 7B is a front elevation view of the lower part of the adjustable radius indicator referred to above.
Figure 7C:
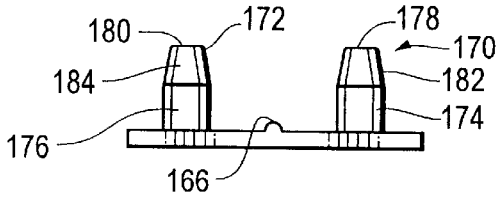
FIG. 7C is a side elevation view of the lower part of the adjustable radius indicator referred to above.
Figure 7D:
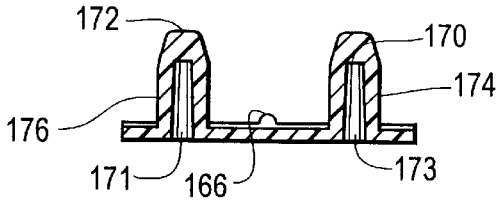
FIG. 7D is a cross-sectional view of the lower part of the adjustable radius indicator taken along lines 7D—7D in FIG. 7A.

Lower part 150 of adjustable radius indicator 18 is shown in FIGS. 7–7F. This part is generally rectangular, having top and bottom surfaces 151 and 153, ends 152 and 154, and elongated outer edges 156 and 158. The lower part is of a length corresponding to the length of transverse slot 144 in base 105 of upper part 100 to permit the lower part to fit snugly lengthwise in the slot. The width of the lower part is at least slightly greater than the width of elongated cavity 16 in elongated radius arm portion 14 of the tool to prevent the adjustable radius indicator from pulling out of the cavity once the indicator is assembled on the tool. Lower part 150 also includes a pair of upstanding elongated ridges 160 and 162 along edges 156 and 158, and spacing dimples 164 and 166 centered on each of the elongated ridges.

Finally, lower part 150 includes a pair of upstanding pins (or handles) 170 and 172 which are generally hollow at blind bores 171 and 173 (to facilitate molding), and dimensioned at their respective bases 174 and 176 to fit snugly in bores 134 and 136 of upper part 100. The pins are rounded at their tips 178 and 180 to facilitate molding and insertion in bores 134 and 136 in the upper part. The pins are also tapered at their top portions 182 and 184 so that when the user grasps these pins to use them as handles they are easier to grasp to move adjustable radius indicator along cavity 16.

Figure 8A:
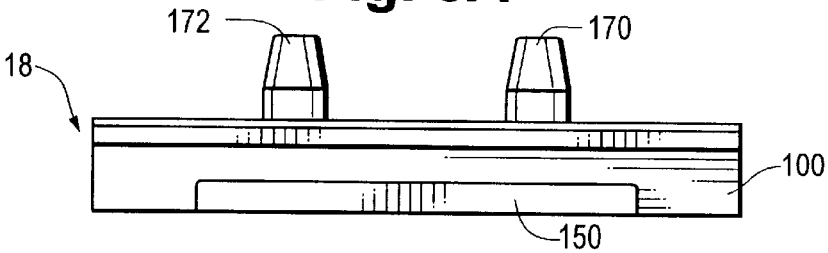
FIG. 8A is a side elevation view of the adjustable radius indicator with the upper and lower parts assembled.
Figure 8B:
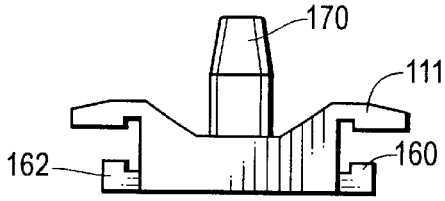
FIG. 8B is a front elevation view of the adjustable radius indicator with the upper and lower parts assembled.

The adjustable radius indicator may be assembled to the tool by positioning the lower part 150 under the radius arm portion, with elongated ridges 160 and 162 of the lower part in elongated slots 54 and 56 of the radius arm portion. The upper part 100 is then positioned above the radius arm, with pins 170 and 172 opposite bores 134 and 136 in the upper part. The upper and lower parts are then pressed together to lock the adjustable radius indicator onto the radius arm portion in a fit having sufficient clearance to permit the adjustable radius indicator to slide within the elongated slot when the user moves it yet sufficiently snug to "brake" or automatically restrain the indicator to prevent unwanted movement once the indicator is set at the desired location. This snug fit and automatic resistance to indicator movement is aided by pressure dimples 164 and 166 in the lower part of the indicator. The fully assembled adjustable radius indicator (sans the radius arm portion) is shown in FIGS. 8A and 8B.

The drawing tool of the present invention may be used to draw an infinite number of perfect circles. In order to do so, the adjustable radius indicator typically is placed in the desired position with hole or circular pivot point 24 over either a dot on the drawing surface or the vertex point of an angle. Since the pivot disc is clear and has a through-opening at the pivot point, properly positioning the tool over the dot or vertex is particularly easy to accomplish. Next, the user presses down upon the pivot disc which contacts the drawing surface at its bottom dimples and remains in place on the surface while a pen or pencil is pressed with its point through one of the drawing holes in the adjustable radius indicator, with the drawing instrument resting on the drawing surface. The pen or pencil is then swung in an arc about the pivot disc to form a circle of the desired radius.

Figure 9:
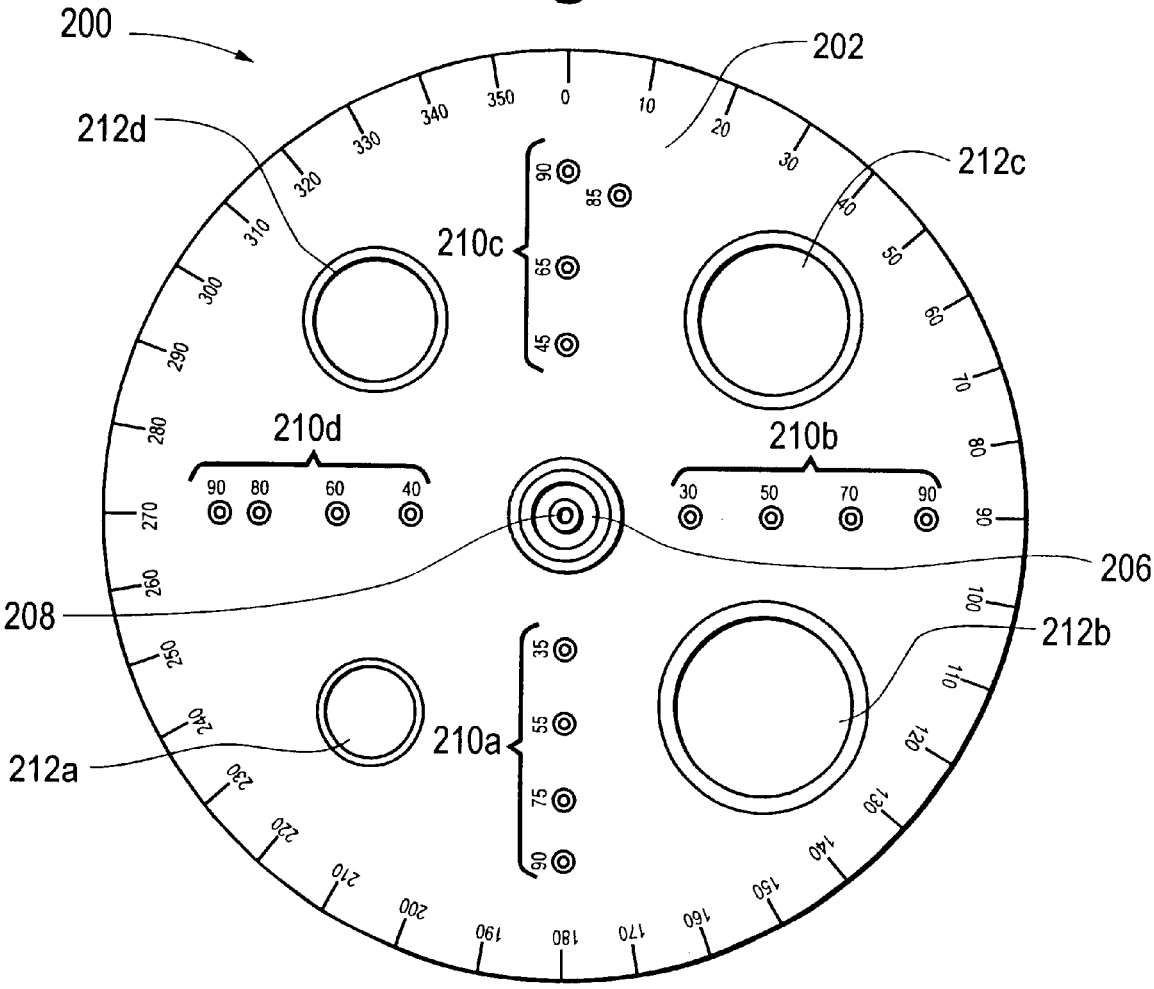
FIG. 9 is a compass tool employing the pivot disc of the present invention.

Many of the unique advantages of the drawing tool of FIGS. 1–8 may be employed in other drawing tool configurations. For example, as shown in FIG. 9, a compass tool 200 comprising a large circular member 202 having a series of degree markings along its outer edge 204 may employ a pivot disc 206 of the same design as that shown in previous figures. Thus, pivot disc 206 is rotatably mounted at the center of compass 200 described above. Pivot disc 206 includes an open circular pivot point 208. Thus, positioning of compass 208 is facilitated in the same way as positioning of the tool of FIGS. 1–7, namely, the clear pivot disc with its through opening makes clear visible positioning of the center hole over the desired location on the drawing surface particularly easy to accomplish. Once positioned, the user presses down upon the pivot disc which remains in place on the surface while the drawing instrument is pressed with its point through one of the groups of edge-beveled holes 210*a*–210*d*, or moved about the circumference of one of the enlarged edge-beveled holes 212*a*–212*d*.

While the invention has been described in relation to a preferred embodiment, those skilled in the art may develop wide variations in structural details without departing from the principles of the invention. Accordingly, the appended claims are intended to be construed to cover all equivalents falling within the scope and spirit of the invention.

What I claim is:

1. A drawing tool comprising:

a first member adapted to rest against a drawing surface, the first member having an opening for receiving the tip of a drawing instrument for pressing through the opening onto the drawing surface; and a second member rotatably mounted in the first member, the second member having a circular pivot point comprising a through-opening, whereby the tool may be positioned on a drawing surface with the open circular pivot point of the second member aligned over a desired position appearing on the drawing surface and the second member pressed against the drawing surface while the first part is rotated thereabout with the drawing instrument against the drawing surface, to produce the desired markings on the drawing surface.

2. The drawing tool of claim 1 in which the first member is elongated and includes a protractor portion at one end of the member.

3. The drawing tool of claim 1 in which the first member includes an elongated rectangular cavity centered on the longitudinal axis thereof, and an adjustable radius indicator mounted in the elongated cavity, the adjustable radius indicator including means for automatically resisting unintended indicator movement.

4. The drawing tool of claim 3 in which the means for resisting unintended indicator movement comprises spring members biased against the inner edges of the elongated slot.

5. The drawing tool of claim 3 in which the means for resisting unintended indicator movement comprises pressure dimples for riding in and engaging slots alongside the elongated rectangular cavity.

6. The drawing tool of claim 1 in which the second member is clear or translucent and has at least one line, visible from the top of the second member, intersecting the circular pivot point.

7. The drawing tool of claim 1 in which the underside of the first member includes a plurality of dimples to minimize smudging of markings already on any drawing surface located under the drawing tool.

8. The drawing tool of claim 1 in which the second member includes dimples on the bottom surface thereof spaced about the circular pivot point to help resist unintended movement of the second member.

9. The drawing tool of claim 2 including spurs at opposite ends of the tool, one projecting proximally from the protractor portion and the other projecting distally from the distal end of the first member.

10. The drawing tool of claim 1 including a hole designed to permit a ring of a ring binder to pass therethrough.

11. The drawing tool of claim 3 including outwardly directed pointer portions on the lateral edges of the adjustable radius indicator.

12. The drawing tool of claim 3 in which the adjustable radius indicator includes handles in the form of upstanding pins.

13. The drawing tool of claim 12 in which a pair of upstanding pins are provided.

14. The drawing tool of claim 3 in which the adjustable radius indicator rides in elongated slots in the bottom of the first member and along upstanding elongated ridges in the top of the first member.

15. A compass tool comprising a circular member with holes in its surface and a pivot disc rotatably mounted at the center thereof, the pivot disc having a open circular pivot point comprising a through-opening.

16. The compass tool of claim 15 in which the pivot disc is clear or translucent and has at least one line visible from the top of the second member intersecting the circular pivot point.

17. The compass tool of claim 15 in which the underside of the circular member includes a plurality of dimples to minimize smudging of markings already on any drawing surface placed below the drawing tool.

18. The compass tool of claim 15 in which the pivot disc includes dimples on the bottom surface thereof spaced about the circular pivot point to help resist unintended movement of the second member.

19. A drawing tool comprising:

a first member adapted to rest against a drawing surface, the first member having an opening for receiving the tip of a drawing instrument for pressing through the opening onto the drawing surface;

the first member including an elongated rectangular cavity generally centered on the longitudinal axis thereof, and an adjustable radius indicator mounted in the elongated cavity, the adjustable radius indicator including means for automatically resisting unintended indicator movement; and a second member rotatably mounted in the first member, the second member having a circular pivot point comprising a through-hole;

whereby the tool may be positioned on a drawing surface, with the through-hole of the circular pivot point of the second member aligned over a desired position appearing on the drawing surface and the second member pressed against the drawing surface while the first part is rotated thereabout with the drawing instrument against the drawing surface to produce the desired markings on the drawing surface.

20. The drawing tool of claim 19 including upstanding pins in the adjustable radius indicator to assist the user in moving the indicator.

* * * * *